United States Patent [19]

Koyanagi et al.

[11] Patent Number: 4,517,940

[45] Date of Patent: May 21, 1985

[54] INTAKE DEVICE FOR INTERNAL COMBUSTION ENGINE

[75] Inventors: Takahiro Koyanagi; Hiromu Sakaoka, both of Asaka, Japan

[73] Assignee: Honda Giken Kogyo Kabushiki Kaisha, Tokyo, Japan

[21] Appl. No.: 558,683

[22] Filed: Dec. 6, 1983

[30] Foreign Application Priority Data

Dec. 6, 1982 [JP] Japan ..... 57-213570

[51] Int. Cl.[3] ..... F02B 77/00

[52] U.S. Cl. ..... 123/198 E; 123/52 MB; 123/195 C; 123/580; 55/385 B

[58] Field of Search ..... 123/198 E, 195 C, 579, 123/580, 52 MB; 55/385 B, DIG. 28

[56] References Cited

U.S. PATENT DOCUMENTS

| | | | |
|---|---|---|---|
| 2,963,009 | 12/1960 | Dolza | 123/198 E |
| 3,810,526 | 5/1974 | Kawasaki | 123/198 E |
| 3,966,014 | 6/1976 | Gowing | 123/198 E |
| 4,354,458 | 10/1982 | Bury | 123/198 E |
| 4,364,340 | 12/1982 | Kimura | 55/385 B |
| 4,418,676 | 12/1983 | Iwao | 123/580 |

FOREIGN PATENT DOCUMENTS

| | | | |
|---|---|---|---|
| 1526699 | 9/1970 | Fed. Rep. of Germany | 123/198 E |
| 2306131 | 8/1974 | Fed. Rep. of Germany | 123/198 E |
| 72229 | 6/1981 | Japan | 123/579 |
| 77548 | 6/1981 | Japan | 123/198 E |
| 183555 | 11/1982 | Japan | 123/198 E |

*Primary Examiner*—Ira S. Lazarus

*Attorney, Agent, or Firm*—Pollock, Vande Sande & Priddy

[57] ABSTRACT

Intake device for multiple cylinder I.C. engine, the intake opening of the carburetor for each cylinder being connected with a carburetor base connected to an air cleaner in chamber form. The chamber intake openings for each carburetor are separated by partition plates.

3 Claims, 7 Drawing Figures

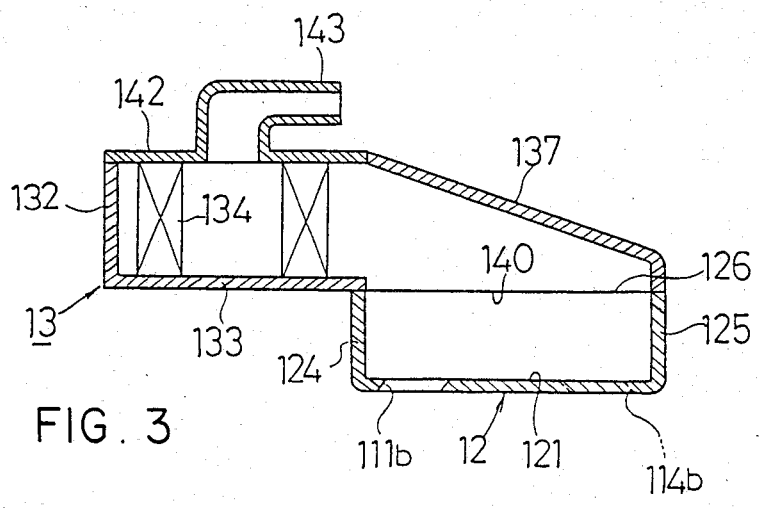
FIG. 3
FIG. 4
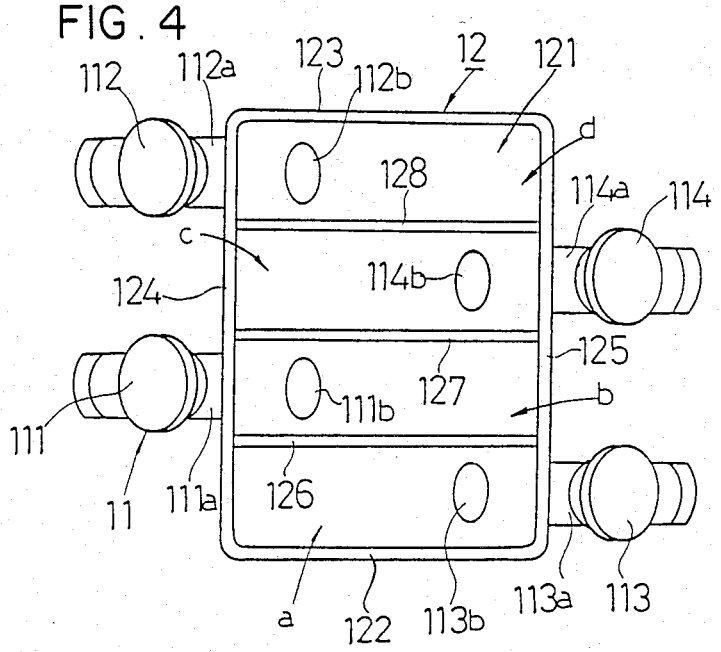
FIG. 7
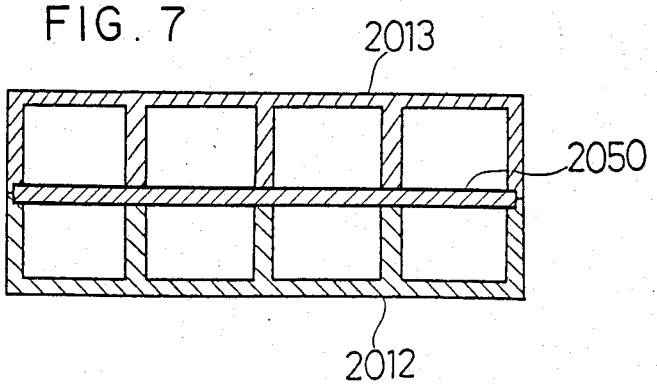

INTAKE DEVICE FOR INTERNAL COMBUSTION ENGINE

SUMMARY OF THE INVENTION

The invention relates to an intake device for an internal combustion engine having multiple cylinders, each provided with a carburetor, with the intake openings of the carburetor for each cylinder connected with a carburetor base, which is connected to an air cleaner in chamber form. Partition plates are placed between the areas of the intake openings for each carburetor opening into the said base, so as to serve as partitions between the opening areas.

BACKGROUND OF THE INVENTION

Engines with several cylinders are used in two wheeled motor vehicles and other vehicles. For example, in the case of a V type four cylinder engine, a serially aligned four cylinder engine, and other such engines, the distances between the intake openings of each cylinder are relatively small, and further, the configurations around them vary. In cases where there are differences in intake resistance, a great deal of air may be taken in by some particular intake openings, while the air intake is reduced in quantity for other intake openings. In other words, there are many cases involving an arrangement for the various intake openings in an intake system, when the openings are placed adjacent to each other due to considerations of space or the like, it is quite possible for intake quantity imbalances to arise due to the conformation around the openings and other such factors.

In the design of internal combustion engines, in cases where there are multiple cylinders, it is hard to set out the air intake system circuits in the same manner for each cylinder, so that the aforementioned imbalances in the air intake quantities for each cylinder can easily arise, causing such malfunctions as imbalances in intake volume effectiveness, imbalances in carburetor settings, and the like, to occur. In particular, in the case of the constant vacuum type of carburetor, of the form in which the throttle opening degree is made larger in proportion to the intake quantity, the throttle does not open for cylinders where the intake quantity is small, while the degree of opening for cylinders with a large quantity of intake is great, and the imbalances of intake volume effectiveness, output, carburetor settings, and the like, become all the greater.

For instance, in the case of the structure shown in FIG. 6, with a carburetor base for a four cylinder V type engine where multiple cylinders are arranged front and back, an air cleaner (not shown in the figure) is connected on top of the base 51, and on the lower wall of base 51 there are openings 52*a*, 52*b*, 52*c*, and 52*d*, made as intake connection openings for the carburetors 52 for each of the cylinders. There are variations in the distances between the outer rim wall area 53 of the base 51 and the various intake connection openings, particularly in the cases of distances to the left and right relative to the rim wall area sides 53*a* and 53*b*, and as there is variation in the configurations involved, it is easy for imbalances in intake volume among the various cylinders to occur.

OBJECTION OF THE INVENTION

The present invention is intended to resolve the imbalances in intake quantity among the various cylinders of an engine with multiple cylinders, and to achieve an equalized balance of intake quantity for each cylinder.

It is an object of the present invention to provide an intake device for an internal combustion engine made in such a fashion that it achieves a rise in performance capacity for the multiple cylinder engine as a whole, by making the configurations around the intake connection openings for each cylinder of the multiple cylinder engine more or less the same, having a set intake quantity for each cylinder, balancing the intake effectiveness among the cylinders, balancing output, balancing the carburetor settings, and the like.

In order to achieve this objective, the carburetor base connected with the air cleaner is made in chamber form, and partition plates are located in the spaces between the carburetor intake openings made in the several respective spaces in the carburetor base, the structure being so formed as to make the configuration around each intake opening more or less the same.

BRIEF INTRODUCTION TO THE DRAWINGS

In order that the invention may be more clearly understood, reference will now be made to the accompanying drawings, wherein several embodiments are shown for purposes of illustration, and wherein:

FIG. 3 is a plane view of the carburetor base.

FIG. 4 is a longitudinal sectional view of the connections with the air cleaner.

FIG. 7 is a longitudinal sectional view of an embodiment incorporating a frame trap.

DESCRIPTION OF PREFERRED EMBODIMENT

Figure 1:
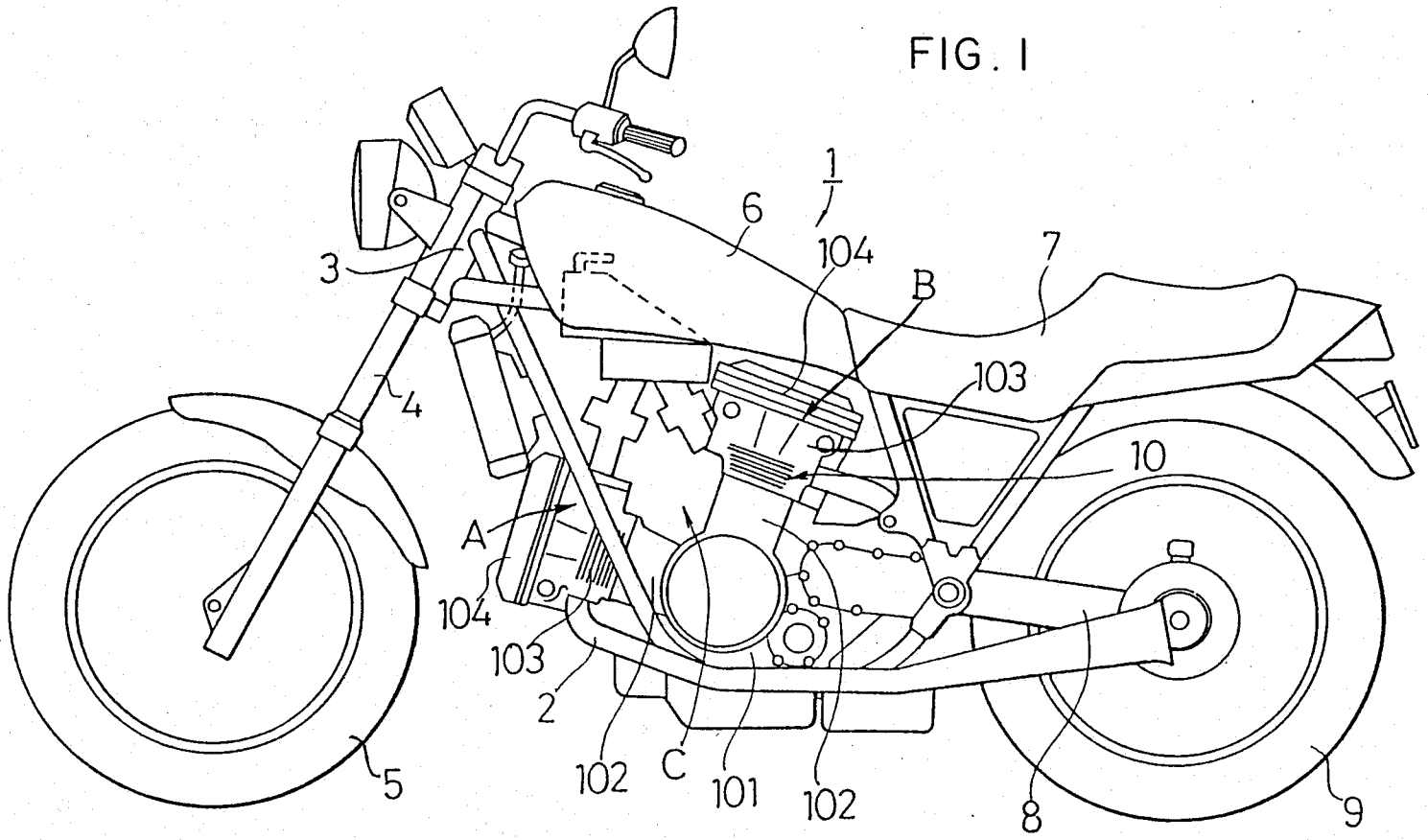
FIG. 1 is a side view of a two wheeled motor vehicle.

FIG. 1 is a general side view of a two wheeled motor vehicle 1, comprising head tube 3 at the front end of frame 2. Front fork 4, which carries front wheel 5, is supported so that it operates freely. At the upper front area of frame 2, there is placed fuel tank 6, with seat 7 attached behind it. Rear fork 8 extends from the lower rear area of the frame, and supports rear wheel 9.

At the lower front area of frame 2, there is supported engine 10. In the illustrated example, this is a 90° V-type engine, viewed from the side, with a crankshaft lateral arrangement; it is a four cylinder engine, with two front cylinders and two rear cylinders, each set comprising a left-hand and a right-hand cylinder at a distance from each other. The engine 10 is made up of a casing 101, which consists of the transmission case and the crank case. Above this are located cylinder blocks 102, arranged in V fashion; above these are cylinder heads 103, surmounted by cylinder head covers 104. On the upper part, placed to the right and left, at the front, are the cylinder ports for two cylinders, while at the rear, to the right and left, are the cylinder ports for two more cylinders, with openings facing frontwards. The carburetors 11 are located from the center to the upper area of a space C between the front and rear cylinders A and B; in the illustrated example, there are four carburetors 111–114 (see FIG. 4), for each of the cylinders.

The intake areas 111*a*–114*a* for carburetors 111–114 are set up at relatively corresponding spaces with respect to each other to the right and left, and above the space between intake areas 111*a*–114*a* there is placed the carburetor base 12. The latter has the shape of a box opening at the top, and walls 122–125 as the four sides of its lower wall 121. The upper flow ends of intake areas 111*a*–114*a* of the respective carburetors 111–114 open into lower wall 121 in the form of intake openings 111*b*–114*b*. As shown in FIG. 4, intake opening 113*b* of carburetor 113 at the left rear side is joined at a position near the left side wall 122 at the rear of lower wall 121; intake opening 111*b* of carburetor 111 at the left front side is joined at a position farther from left side wall 122 at the front of lower wall 121; intake opening 114*b* of carburetor 114 at the left side of the rear area is joined at a position farther from right side wall 123 of the lower wall; and, carburetor 112 at the left side of the front area has its opening joined at a position near the right side wall 123 at the front area of the lower wall. Thus air intake openings 111*b*–114*b* are distributed to front and back, right and left, in relative corresponding positions, without overlap, joined at positions in the lower wall. As for the sparking order of the intake system described above, inclusive of the carburetors, the progression is from carburetor 113 to carburetors 112, 114 and 111 in succession.

Above lower wall 121 of base 12, partition plates 126–128 are inserted with their ends against the front and back walls 124 and 125; partition plate 126 is set in place so as to divide the space between intake openings 113*b* and 111*b*, partition plate 127 is placed so as to divide the space between intake openings 111*b* and 114*b*, and partition plate 128 is placed so as to divide the space between intake openings 114*b* and 112*b*. As a result, the left and right end walls 122 and 123, as well as the partition plates 126–128, divide up the spaces around intake openings 111*b*–114*b* more or less evenly, creating roughly uniform volume area spaces a-d, which are open at the top.

Figure 2:
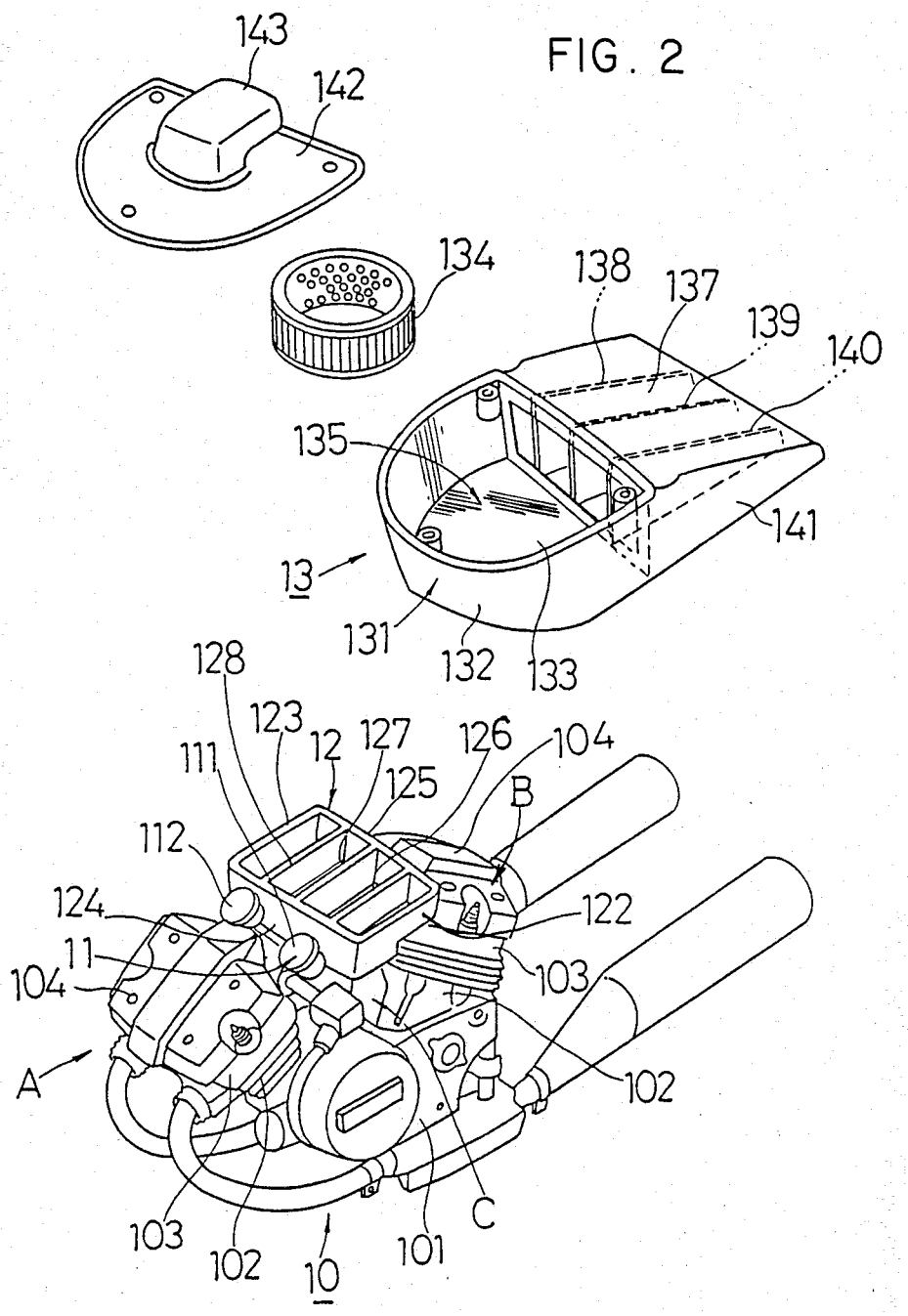
FIG. 2 is an exploded perspective view of the engine showing the intake device.
Figure 6:
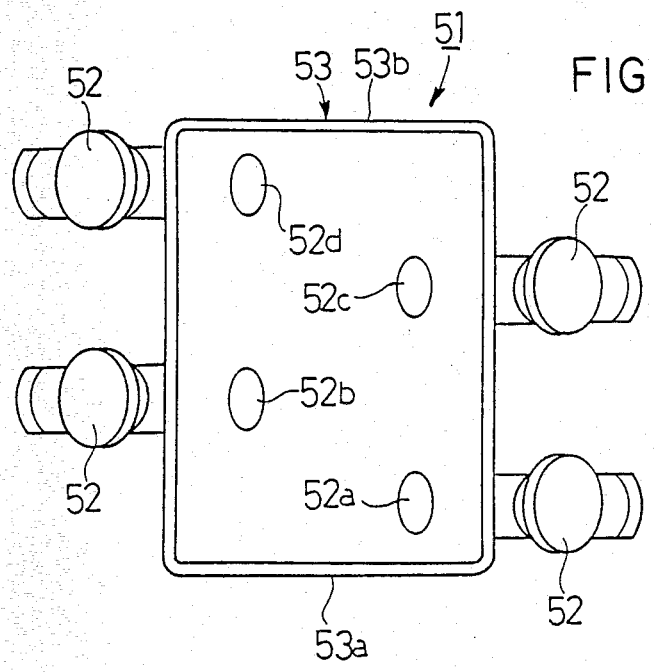
FIG. 6 is a prior art version of the air cleaner connections shown in FIG. 4.

On top of base 12, there is installed an air cleaner 13. The casing 131 for air cleaner 13 is shown in FIG. 2. The front area is enclosed by the enclosure wall 132. The receiver section 135 is placed so as to receive element 134, with lower wall 133. The rear area 136 is so formed as to make a double base construction when placed on top of the base 12, and this section is connected with the receiver section 135. The top wall 137 has arranged below it, from front to back, the partition plates 126–128, with partition segments 138–140 fitted vertically so as to fit with the partition plates 126–128. Top wall 137 slopes down towards the rear, and the open spaces between the partition segments are 138–140 are connected with the receiver section 135. Casing 131 is so formed that its rear area 136 fits on top of base 12 in layered fashion, and partition plates 138–140 fit on in such a way that they form the upper half of the base. The left and right walls 141 of the rear area fit vertically with side walls 122, 123 of the base vertically. In this fashion, an intake circuit is formed such that the intake openings 111*b*–114*b* in the carburetor base, connecting with the air cleaner 13, each have the same conformation and the same volume capacity. In FIG. 2, 142 is a cover arrangement containing the intake section 143, which takes in exterior air.

Figure 5:
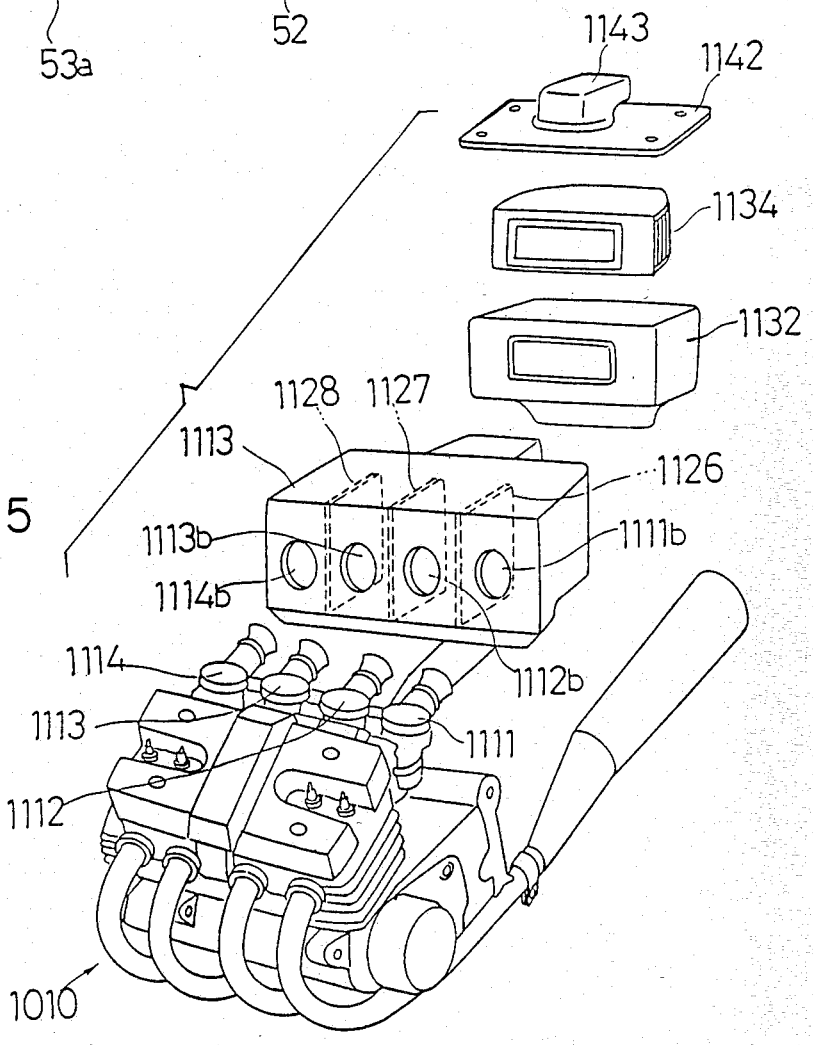
FIG. 5 is a perspective view of a further embodiment of the invention.

FIG. 5 shows an engine 1010 having four cylinders in a straight series arrangement. The carburetors 1011–1014 for each of the cylinders of this engine are connected with openings 1111*b*–1114*b* in the air cleaner case 1113, which serves as the carburetor base. The partition plates 1126–1128 are installed vertically, so as to divide the spaces between the opening areas. By means of a joint 1113*a* at the rear of air cleaner case 1113, there is connected element body 1132, which receives element 1134. The structure is covered by a cover 1142, having an intake section 1143, which is located above the element body 1132. Instead of a four cylinder engine, engines having three, five or more cylinders could also be used.

FIG. 7 is an illustration of a structure in which the vertically protruding upper and lower partitions for the base 2012 and the air cleaner 2013 have a frame trap 2050 placed between them; it is desirable to install such frame trap in this area.

If the present invention is used in the manner described above, due to the fact that partitions are placed so as to divide the spaces up between each of the intake openings for each of the cylinders, in the carburetor base, the conformation around each of the intake openings is more or less the same, and accordingly imbalances in the intake quantities are largely prevented, an equal balance of intake volume is achieved for each of the cylinders, provisions are made for balance of the carburetor settings, balance of the output, balance of the volume effectiveness, and the like, for each cylinder, and the performance capability of a multiple cylinder engine is increased. In addition, these advantages are obtained by making use of such a simple construction as the installation of partition plates.

What is claimed is:

1. An intake device for an internal combustion engine having a plurality of cylinders each provided with a carburetor, each of said carburetors having an intake opening connected with a carburetor base, an air cleaner located above said cylinders, said intake device comprising said carburetor base connected on the upstream side thereof to said air cleaner and on the downstream side thereof to said intake openings, said carburetor base having vertical partition means therein for evenly dividing the space defined by said carburetor base, said partition means extending substantially in the direction parallel to an imaginary line connecting each intake opening and one of the respective carburetors, each of said intake openings being joined to one of the divided spaces of said carburetor base.

2. An intake device according to claim 1, wherein said carburetor base has a generally box-like shape open at the top, and a lower wall having a plurality of intake openings located on the left-hand and right-hand sides of both the front and rear portions of said carburetor base, each of said intake openings being connected to an intake opening of one of said carburetors.

3. An intake device according to claim 2, wherein said air cleaner container is located on top of said carburetor base and has vertical partition segments therein for alignment with said partition means in said carburetor base, the spaces between said segments being in communication with a receiving area for an air cleaner, whereby an intake circuit is formed comprising said intake openings in said carburetor base and said air cleaner.

* * * * *